United States Patent [19]

Croucher et al.

[11] 4,201,001

[45] May 6, 1980

[54] EARTH MOVING EQUIPMENT

[76] Inventors: Robert L. Croucher, Sherwood, Martins Hill La. Burton; Ernest G. Robson, 19 Seafield Rd., Friars Cliff, both of Christchurch, Hampshire, England

[21] Appl. No.: 914,690

[22] Filed: Jun. 12, 1978

Related U.S. Application Data

[63] Continuation of Ser. No. 744,347, Nov. 23, 1976, abandoned, which is a continuation of Ser. No. 568,813, Apr. 17, 1975, abandoned.

[30] Foreign Application Priority Data

Jan. 22, 1975 [GB] United Kingdom ..... 2480/75

[51] Int. Cl.[2] ..... E02F 3/24

[52] U.S. Cl. ..... 37/190; 172/510; 172/540

[58] Field of Search ..... 37/189, 190, 91–97, 37/70, 65–67; 172/510, 521, 527, 540–544, 548, 549, 554

[56] References Cited

U.S. PATENT DOCUMENTS

| | | | |
|---|---|---|---|
| 1,175,174 | 3/1916 | Peterson | 37/97 |
| 1,575,962 | 3/1926 | Bello | 37/94 |
| 1,858,327 | 5/1932 | Hays | 37/190 X |
| 2,190,240 | 2/1940 | Miller | 172/510 X |
| 2,319,255 | 5/1943 | Norton | 37/96 |
| 2,657,620 | 11/1953 | Meeks | 172/549 X |
| 2,711,035 | 6/1955 | Pitts | 37/189 |
| 2,857,835 | 10/1958 | Fitzgerald | 37/142 R |
| 3,584,406 | 6/1971 | Kershaw | 172/540 X |

FOREIGN PATENT DOCUMENTS

| | | | |
|---|---|---|---|
| 215005 | 12/1956 | Australia | 172/510 |
| 858785 | 2/1952 | Fed. Rep. of Germany | 37/189 |
| 867019 | 2/1953 | Fed. Rep. of Germany | 172/540 |
| 2010614 | 9/1971 | Fed. Rep. of Germany | 37/66 |
| 913787 | 9/1946 | France | 37/94 |
| 1464063 | 12/1966 | France | 37/94 |
| 445545 | 1/1967 | Switzerland | 37/94 |
| 142095 | 5/1921 | United Kingdom | 37/94 |
| 689985 | 4/1953 | United Kingdom | 37/189 |
| 698238 | 10/1953 | United Kingdom | 37/94 |
| 997438 | 7/1965 | United Kingdom | 37/66 |
| 1380398 | 6/1972 | United Kingdom | 37/95 |

*Primary Examiner*—E. H. Eickholt

*Attorney, Agent, or Firm*—Kerkam, Stowell, Kondracki & Clarke

[57] ABSTRACT

A cutting tool for an excavating machine is described which comprises a support arm having an inner end adapted to be movably mounted on the machine and an outer end, a shovel member having a substantially flat working face and carried by the support arm at its outer end, and a plurality of cutting teeth arranged to contact the material to be excavated in advance of the said shovel member and fixed rigidly thereto, the arrangement being such that the said working face is substantially perpendicular to its direction of motion as it contacts the material to be excavated. Assemblies of such cutting tools are also described, which are particularly smooth and efficient in operation.

1 Claim, 4 Drawing Figures

EARTH MOVING EQUIPMENT

This is a continuation of application Ser. No. 744,347, filed Nov. 23, 1976, now abandoned, which is a continuation of Ser. No. 568,813, filed Apr. 17, 1975, now abandoned.

This invention relates to earth moving machinery, and in particular to cutting tools and assemblies of cutting tools for earth moving machinery.

In known forms of earth moving machinery, the tractive effort required is frequently very great, and may absorb a major part of the power output of the machine. Furthermore, in order to ensure that frictional forces developed between the machine and the ground are sufficient to transmit the tractive efforts required, the weight of the machine must often be considerably greater than would otherwise be necessary. This in turn leads to a requirement for still greater tractive effort. However, these problems may be alleviated by the employment of a cutting tool assembly forming a separate part of the earth moving machine, which is caused to move relative to the machine. This movement may be, for example, of a rotary or oscillatory nature. The action of such a cutting tool assembly is to break up the soil, so as to enable it to be more easily shovelled or otherwise moved. The soil may then, for example, be collected in a bucket arrangement attached to or associated with the cutting tool. A machine which employs a cutting tool of this type will require a relatively small tractive effort, and will therefore be capable of operation under adverse conditions where other machines might become ineffective.

In order to reduce the required power output to the minimum, it is desirable that the cutting tool should operate with maximum efficiency. This is particularly so when the machine is self-propelling, as power absorbed by the cutting tool reduces the power available for traction. Desirably also, the cutting tool should operate as smoothly as possible in order to ensure even progression and a steady power output, so that the maximum instantaneous power output required of the machine may be kept as low as possible.

Accordingly the present invention is directed to providing a cutting tool for an earth moving machine which is effective in cutting, breaking and excavating a wide variety of soils, minerals, and other materials under various environmental conditions. In further aspects, the invention seeks to provide an assembly of such cutting tools which is particularly smooth in operation. These and other aspects of the invention will be apparent from the following description.

According to the present invention a cutting tool for an excavating machine comprises a support arm having an inner end adapted to be movably mounted on the machine and an outer end, a shovel member having a substantially flat working face carried by the support arm at its outer end, and a plurality of cutting teeth arranged to contact the material to be excavated in advance of the shovel member and fixed rigidly thereto, the arrangement being such that the flat face of the shovel member is substantially perpendicular to its direction of movement as it contacts the material to be excavated.

Preferably the cutting teeth are all fixed to the substantially flat surface of the shovel member and extend in directions both perpendicular thereto and parallel thereto.

Preferably also the cutting teeth are fixed to the shovel member in spaced relationship so that some of the material to be excavated may pass between them.

Very conveniently the cutting teeth are welded to the shovel member.

According to a further feature of the invention, a cutting tool assembly comprises a plurality of cutting tools each in accordance with the invention.

Conveniently such an assembly includes an axially rotatable member to which the inner end of the support arms are fixed so that the support arms extend generally radially outwards from the rotatable member.

The disposition of the cutting tools on the axially rotatable member is of particular importance to the smooth and efficient operation of the cutting tool assembly.

Most advantageously, the cutting tools are staggered around the circumference of the rotatable member.

Preferably the teeth of successive cutting tools around the circumference are offset from one another in the axial direction of the rotatable member, so that successive teeth cut material which has passed between preceding teeth.

For optimum results, the distribution of cutting tools around the circumference of the rotatable member should be substantially even.

Preferably, the cutting tools should also be staggered along the length of the rotatable member in the axial direction thereof.

Advantageously smooth operation is further ensured by arranging that the cutting tools are disposed symmetrically about the plane passing through the mid-point of the axially rotatable member and perpendicular to the axis thereof. With such an arrangement it is found that end thrusts on the axially rotatable member, and turning moments in the axial plane are reduced to a minimum, thus enabling smoother operation and more precise control.

The invention will now be described by way of example only, with reference to the accompanying drawings, in which FIG. 1 shows a cutting tool in accordance with the invention.

Figure 1:
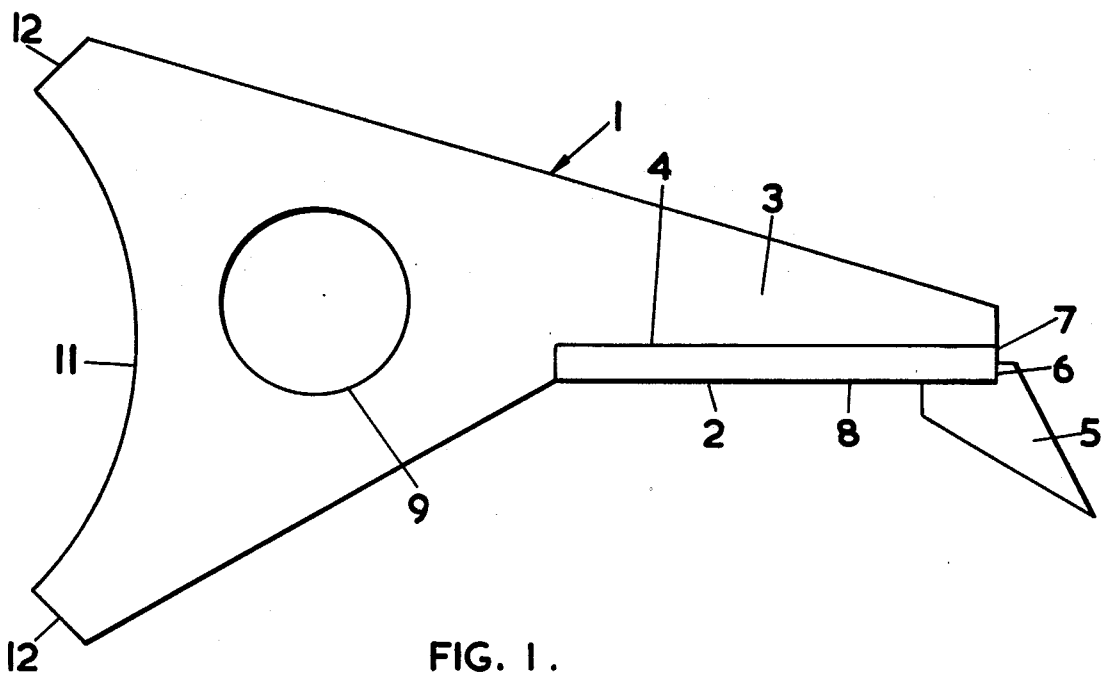

The cutting tool shown in FIG. 1 and indicated generally as 1 comprises a shovel plate 2 carried at the outer end of a support arm 3 in a recess 4 thereon which is shaped to receive it. The arm 3 and the shovel plate 2 are both made from flat plate material, and are fixed at right angles to each other.

Three cutting teeth 5 are disposed along the outer end of the shovel plate so as to extend both forwardly (perpendicular) to the plate and outwardly (parallel) thereto. The dimension of the teeth perpendicular to the plane of the arm is kept relatively small. The teeth 5 are provided with a recess 6 whereby they are located against the outer end of the shovel plate, to which they are fixed by welding along the outer edge 7 and the flat working face 8 of the shovel plate 2.

The support arm 3 is provided with a hole 9 where the design permits, purely for the purpose of saving weight and material.

Figure 2:
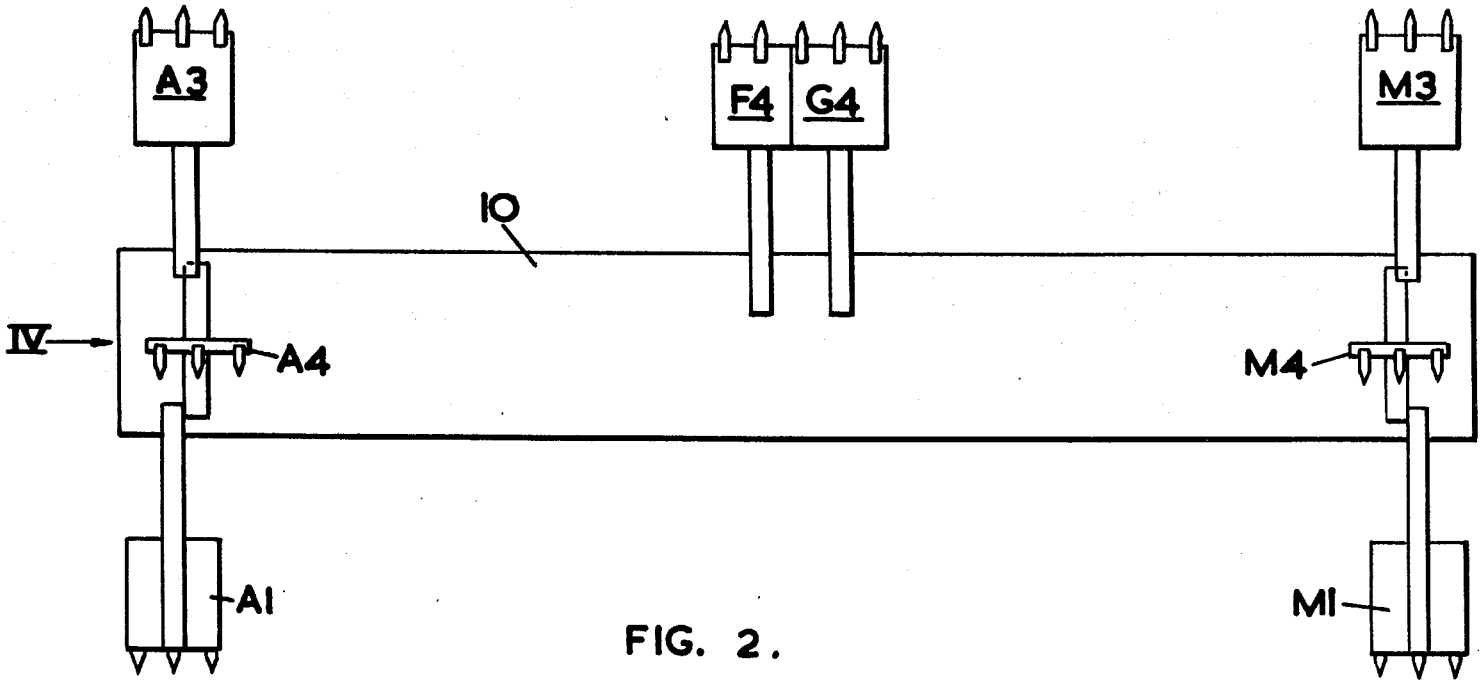
FIG. 2 is a side elevation of a partially assembled cutting tool assembly.
Figure 3:
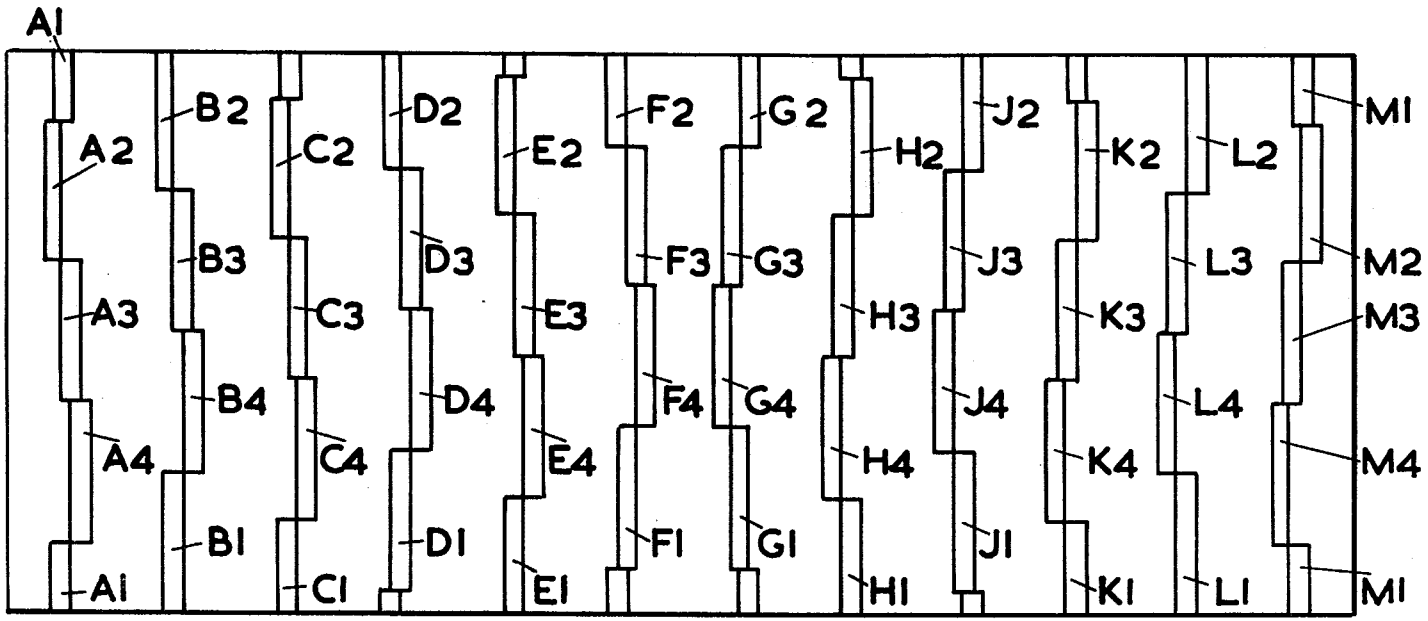
FIG. 3 is a developed view of the outside face of the drum of FIG. 2, showing the positions occupied by the cutting tools.
Figure 4:
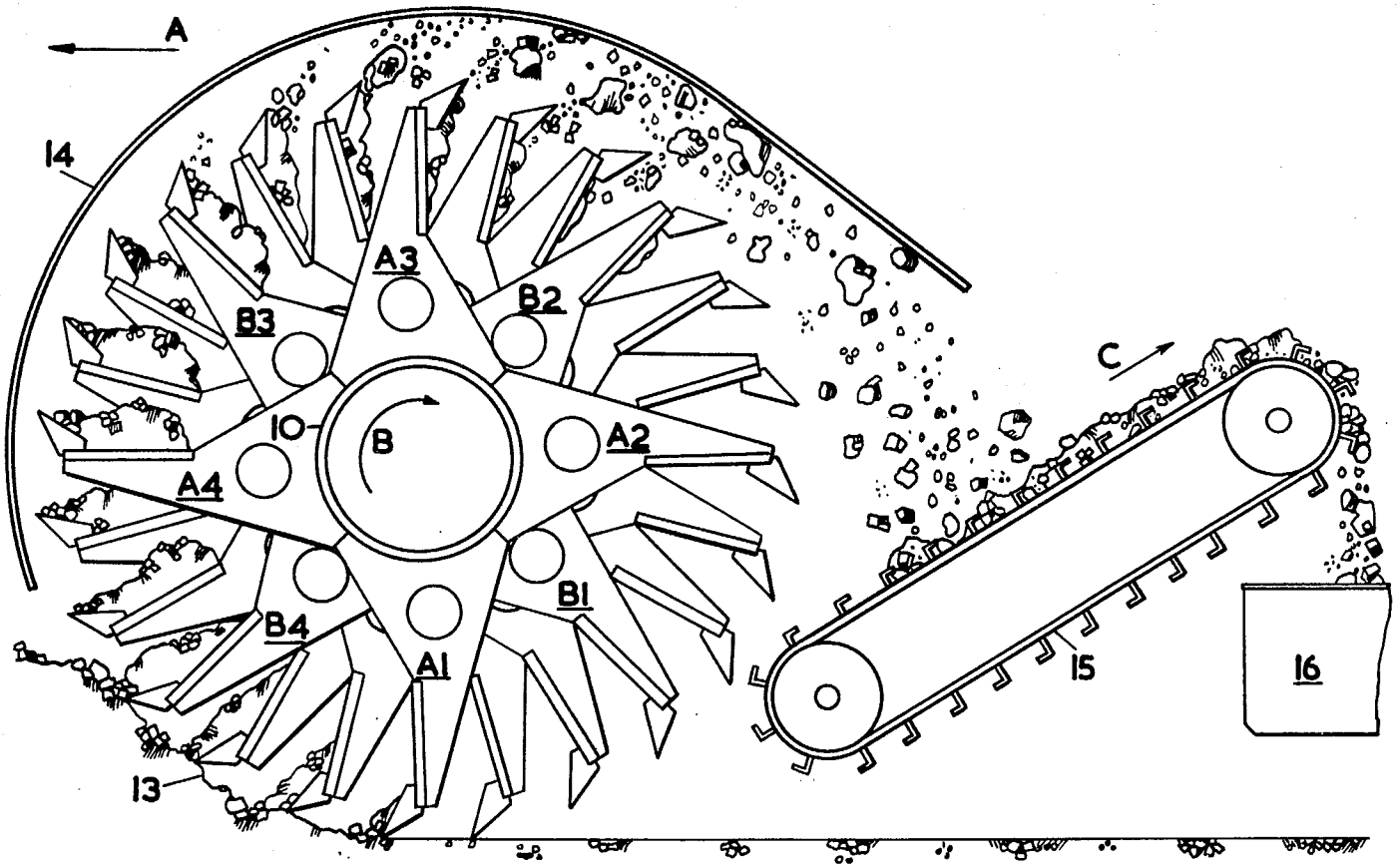
FIG. 4 is an end elevation of a complete cutting tool assembly in operation, viewed in the direction of arrow IV in FIG. 2, plus an associated deflector casing and elevator.

As shown in FIGS. 2 to 4 a cutting tool assembly for an earth moving machine comprises a plurality of cutting tools fixed rigidly to a central drum 10 rotatable about its axis. The inner end of each support arm has an arcuate section 11 to facilitate this fixing, and is provided with shoulders 12 which abut against the shoulders of adjacent arms. The cutting tools 1 are staggered both around the circumference of the drum and axially of the drum in a manner and for reasons explained hereinafter.

The drum 10 is mounted for rotation about its longitudinal axis on an earth moving machine (not shown). The drum 10 may be conveniently driven by a remote power source through any convenient transmission system (not shown) comprising for example, a sprocket and chain arrangement, or a hydraulic motor which could most advantageously be mounted inside the drum 10. In any event, the remote power source is conveniently, in the case of a self-propelled earth moving machine, a suitable power take-off point of the main traction engine.

The operation of the cutting tool assembly in use is as follows. The earth moving machine moves in the direction of the arrow A (FIG. 4) whilst the drum 10 is rotated in the direction of arrow B (FIG. 4). The cutting tool assembly is thus moved forward against the working face 13 of the material to be excavated. By virtue of the rotation of drum 10, successive cutting tools 1 are brought into contact with the soil. In each cutting tool 1, the teeth 5 first contact the soil to loosen and break it up. This results in a small build-up of soil which is carried forwardly and upwardly along the working face 13 to be lifted clear thereof by the working face 8 of the shovel plate 2. The speed of rotation of the assembly is such that the soil carried by the shovel plate 2 tends to be thrown radially outwards by centrifugal forces. This will be to some extent counteracted by the frictional forces between the soil and the shovel plate, but nevertheless, at some point during the revolution of the cutting tool 1 soil material picked up from the working face 13 will be flung off. The cutting tool assembly thus has a centrifugal self-cleaning action, and the need to provide a separate means for removing excavated material from the cutting tool is eliminated. This is particularly important when excavating sticky materials, such as wet clay.

It is desirable in many applications that some means be provided for guiding the excavated material towards a particular required location. This may be, for example, either the ground to one side of the excavated area, or alternatively some suitable collection means. As shown in FIG. 4 only, a deflector casing 14 is provided which partially surrounds the cutting tool assembly over its entire length. The casing extends from just beyond the level of the un-excavated material at the forward side of the cutting tool assembly, to well beyond the top centre position. The height of the casing above the ground on the forward side should preferably be adjustable so as to accommodate varying depths of cut. In some instances the depth of cut may be greater than the diameter of the cutting tool assembly, so that an overhang is formed in the material to be excavated, so the range of adjustment of the casing 14 should be fairly wide. The casing is so shaped that the gap between the tips of the teeth 5 and the inner surface of the casing gradually increases in the direction of rotation of the drum 10 in order to provide passage for increasing quantities of excavated material flung from the shovel plates. The exit angle of the casing is so chosen as to guide the excavated material in the desired direction, and may also be adjustable.

Conveniently an elevator 15 may be provided to the rear of the cutting tool assembly, the elevator being so positioned in relation to the casing 14 that excavated material drops onto the elevator. The elevator surface moves upwardly in the direction of arrow C (FIG. 4). It may then be arranged that the excavated material is disposed of in any desired manner. For example a second elevator (not shown) may be provided which carries the excavated material and deposits it to one side of the machine. Alternatively, the elevator 15 may be arranged to fill a hopper 16 which is periodically discharged.

For efficient operation of the cutting tool and assembly, it is particularly important to ensure that there is no excessive tendency for any permanent accumulation of soil to take place on the cutting tool. The design of the assembly must therefore be such that virtually all the excavated material picked up by a cutting tool 1 at one pass is removed by the centrifugal self-cleaning action described above before a subsequent pass commences. Thus, the design of the cutting tools is such as to eliminate all unnecessary projections and obstacles around which soil might tend to build up.

Thus, the shovel plates 2 have flat working faces 8, which are arranged to be perpendicular to their direction of movement as they engage the soil. In this way the tendency for excavated material to adhere permanently to the shovel plate is kept to a minimum consistent with the requirement that the material should be removed from the working face 13.

For similar reasons, the cutting teeth 5 are kept narrow in directions perpendicular to their plane of motion, and are fixed to the shovel plate 2 by welding in preference to using a bulkier fixing method such as a bolt which might have simplified their replacement. In practice when teeth need replacement owing to wear or damage, they are simply cut off and fresh teeth welded in their place or a replacement shovel plate and tooth assembly may be fitted. Long tooth life may be achieved without undue expense by using a high grade steel for the teeth only, and a less expensive grade for the shovel plates which are subject to less wear.

The tendency for excavated material to build up on the cutting tools is further reduced by the employment of support arms 3 for the shovel plate 2. This open type of construction permits excavated material to pass over the tops of the plates freely rather than becoming compacted towards the centre of the drum.

The relative disposition of the cutting teeth on successive cutting tools, and the relative disposition of the cutting tools themselves is of great importance to the efficient and smooth operation of the cutting tool assembly. As best seen in FIGS. 2 and 3, the cutting tools 1 are arranged in twelve groups of four in each group. For convenience of description, the cutting tools are identified by the positions occupied on the drum 10 by the arcuate sections 11 of their respective support arms 2, which are designated as shown in FIG. 3 by the references A1, A2, A3, A4 (first group); B1, B2, B3, B4 (second group); . . . N1, N2, N3, N4 (twelfth group).

Taking the group A1, A2, A3, A4 as an example, all four cutting tools are identical in construction, and in particular each cutting tool is provided with three teeth 5 disposed in the same relative position along the radially outer edge of the shovel plate 2. The four cutting tools are disposed around the surface of the drum at 90° intervals, with the arms extending radially outwards. Each of the four arms is staggered slightly in the axial direction from the other three, so that during a complete revolution each tooth cuts on a line which is not cut by any other tooth. By this method the whole of the area swept by the cutting tools A1, A2, A3, A4 is evenly cut by the teeth thereof during a complete revolution. It is found in practice that this staggering of the teeth provides a particularly effective cutting tool assembly, and furthermore that the excavated surface has a particularly smooth finish. Successive groups of cutting tools B1–B4, C1–C4, etc., along the length of the drum are similarly arranged so that the teeth in each group are similarly staggered, and the area swept by successive groups adjoin one another. Thus an even, smooth and effective cutting action is achieved across the entire width of the drum. As will be readily apparent a similar staggering of teeth might alternatively be achieved by changing the numbers and/or the relative positions of the teeth on successive cutting tools in each group, instead of staggering successive cutting tools axially within each group.

In addition to the axial staggering of the cutting tools, it is also found beneficial to stagger the arms 3 of successive groups of cutting tools in the circumferential direction. Thus, whilst each group consists of four cutting tools disposed around the circumference at 90° intervals, the groups themselves are displaced circumferentially with respect to adjacent groups. Thus, the group B1, B2, B3, B4 is displaced circumferentially with respect to group A1, A2, A3, A4 by 45°, group C1, C2, C3, C4 is displaced circumferentially with respect to group B1, B2, B3, B4 by 30°, etc. The circumferential staggering is so arranged that the cutting tools are distributed evenly around the drum at 15° intervals. For reasons explained below, the cutting tools are disposed symmetrically in pairs on the drum. The number of pairs of cutting tools engaging the soil at any instant is thus substantially constant, this contributes considerably to the smooth operation of the cutting tool assembly, the power required remaining substantially constant throughout the complete revolution of the drum.

The arms are disposed symmetrically about the plane passing through the mid-point of the drum axis and perpendicular thereto. Thus for example, the position of tool M2 corresponds exactly to that of tool A2, B3 corresponds to L3, E3 corresponds to H3, etc. It is found that this arrangement eliminates end thrusts and twisting moments to which the assembly would otherwise be subjected during use, owing to the asymmetric cutting action which would otherwise occur. This gives rise to a machine in which the loads on the bearings supporting the drum are reduced, and operation is both smoother and more easily controlled with accuracy. In the case of the two cutting tools F4, G4 their relative disposition in the assembly is such that they would overlap. In the case of this pair only, therefore, a section including one tooth is cut from the side of the shovel plate of cutting tool F4, so that the two shovel plates abut. They are then welded together along their abutting edges. Similarly the shovel plates of cutting tools F3 and G3 abut (without cutting) and are welded together.

Whilst the material with which the cutting tool and assembly is to operate has been referred to in the specification variously as soil, minerals and other materials, it will be readily understood by those skilled in the art that the invention is capable of excavating a wide variety of material both on the earth's surface and in mining operations beneath the surface, and the invention should in no way be considered as limited to use with any particular material. It should be understood that the invention is also eminently suited to agricultural use for ploughing, especially deep ploughing. Other uses for the invention include land stabilisation, wherein excavated material is mixed with a binder, e.g., lime or cement, before being re-deposited.

By use of a cutting tool assembly in accordance with the invention, an exceptionally smooth excavated surface may be obtained. The wheels or tracks of the excavating machine may therefore run upon the smooth excavated surface produced by the cutting tool assembly, thus permitting exceptionally precise control of the excavating operation.

Such precise control would, for example, enable a machine incorporating cutting tools in accordance with the invention to be constructed, which would further incorporate control means programmed to cut a particular profile. Thus, for instance, a carriageway having a controlled gradient could be formed by a series of such machines passing over previously uneven ground. Alternatively, the machine could be arranged to control the height and attitude of the cutting tool assembly in response to a signal in the form of, for example, a laser beam, received from a remote point.

The cutting tool is readily adapted for attachment to motivating means having other than purely rotary movement. A series of tools could, for example, be attached to a chain which could be arranged to move around sprockets disposed either vertically or horizontally relative to one another. Such a construction would be particularly suitable for cutting ditches and trenches.

What we claim is:

1. An earth excavating machine adapted to cut, break and excavate soil and minerals over a wide swathe incorporating a cutting tool assembly comprising an axially rotatable drum member and a plurality of cutting tools mounted on and extending radially from said rotatable drum member, in evenly spaced circumferential and axial relationship and distributed substantially symmetrically in pairs about the plane passing through the mid-point of the rotatable drum member perpendicular to the axis thereof, each cutting tool comprising a support arm narrow in the axial direction having an inner end fixed to the rotatable member and an outer end remote from the rotatable member, a shovel member having an unenclosed, flat working face relatively wide with respect to the narrow dimension of said support arm mounted at the outer end of the support arm, and a plurality of cutting teeth disposed in parallel spaced relationship fixed to each shovel member and extending radially outwardly therefrom forwardly of its working face, with the teeth of circumferentially successive cutting tools being offset from one another in the axial direction, the shovel member being mounted with its flat working face in a plane radial with respect to the axis of rotation of said rotatable member and being substantially free of projections other than said teeth, and means for guiding excavated material towards a desired location, said means comprising a deflector casing which partially surrounds the cutting tool assembly from the level of the unexcavated earth in front of the cutting tool assembly upwardly and over said assembly and is so shaped and positioned in relation to the cutting tool assembly that the gap between the tips of the cutting teeth and the inner surfaces of the casing gradually increases in the intended direction of rotation of the cutting tool assembly, the rear edge of said casing lying rearwardly of the path of movement of the cutting teeth of said cutting tools so that, as the machine moves forward and the cutting tool assembly rotates, excavated material is carried upwardly and then rearwardly over the cutting tool assembly between said assembly and the casing.

* * * * *